US005967073A

United States Patent [19]

Petersen

[11] Patent Number: 5,967,073

[45] Date of Patent: Oct. 19, 1999

[54] SAILBOAT SYSTEM FOR CONTROLLED GIBING

[75] Inventor: Ole Simon Petersen, Västra Frölunda, Sweden

[73] Assignee: Simon Petersen Boats AB, Vastra FrolundA, Sweden

[21] Appl. No.: 08/952,903

[22] PCT Filed: May 29, 1995

[86] PCT No.: PCT/DK95/00210

§ 371 Date: Jan. 26, 1998

§ 102(e) Date: Jan. 26, 1998

[87] PCT Pub. No.: WO96/35909

PCT Pub. Date: Nov. 14, 1996

[51] Int. Cl.[6] ..... B63B 15/00

[52] U.S. Cl. ..... 114/91; 114/102.17

[58] Field of Search ..... 114/90, 91, 97, 114/98, 102.2, 102.1, 102.16, 102.17, 104

[56] References Cited

U.S. PATENT DOCUMENTS 4,630,564 12/1986 Duckman ..... 114/98

5,333,567 8/1994 Danzer ..... 114/102

FOREIGN PATENT DOCUMENTS 34 42 740 10/1987 Germany .

*Primary Examiner*—Jesus D. Sotelo

*Attorney, Agent, or Firm*—Darby & Darby

[57] ABSTRACT

A system for controlling the jibe movements of a sailboat boom (4), which boom has an outer free end (5) connected to the boat (4) via a sheeting arrangement (6), and an inner end (7) fixed to the mast (3) via a pivot joint (8). A hydraulic actuator (13) is connected with the inner boom end (7) at the pivot joint (8) via a vertically extending axle (9). The actuator can be controlled to swing the boom over the centerline of the boat during a jibing maneuver, as well as can be adjusted to perform a momentum acting against the swinging of the boom eliminating violent, uncontrolled jibing maneuvers.

11 Claims, 4 Drawing Sheets

SAILBOAT SYSTEM FOR CONTROLLED GIBING

FIELD OF THE INVENTION

The present invention concerns a system for controlling the jibe movements of a sailboat boom , which boom has an outer free end connected to the boat via a sheeting arrangement, and an inner end fixed to the mast via a pivot joint.

CLOSET PRIOR ART

The crossover of the boom is traditionally initiated by a rudder controlled change in the sailing direction of the boat, and by hauling and subsequent releasing of the sheeting arrangement to force the boom over the centerline of the boat. When the jibing manoeuvre is carried out with a larger sailboat, the crossover of the boom is normally very sudden and violent, especially because the high and dangerous boom velocities is reached at angular boom move-ments around the centerline. When the manoeuvre is carried out in strong winds and rough sea conditions, it may be intentional or unintentional, the result can be disastrous, both for the rigmaterial as well as for a person, who is hit by the boom, sheet or other moving parts.

A system that avoids a violent action of the boom at an unintentional gibing manoeuvre, is the well known preventer system comprising a fixed line arrangement attached to the boom, and which runs forward to a safe attachment point on the boat, so that the boom is kept fixed at that perpendicular position in question. At an unintentional jibe this system leaves one with a backwinded sail and an uncontrolled vessel, which can only be brought under control by releasing the arrangement whereafter the boom is totally uncontrolled. Further uncontrollable situations arises if the outer boom end and the sail is dipped into the water caused by rolling movements of the boat.

Other known systems acts as springs by urging the boom into a substantially perpendicular position. These systems does not either give any control of the boom movements, mainly because they are out of function when the boom is approaching the centerline of the boat. The passover of the boom will therefore still be violent and uncontrolled with this system.

U.S. Pat. No. 5,333,567 describes yet another system comprising a passive reacting pneumatic cylinder, the one end of which is connected to the boom and the other end of which is connected to a fixed point on the boat in distance behind the mast. The distance between the connection point on the boom and the fixed point on the deck of the boat will therefore change when the boom is pivoted and the piston of the cylinder will have to move so that a pressure is build up in the cylinder by the instant closure of a throttle opening and the cylinder actuates a passive force during further swinging of the boom. This system is unable to control the boom movement when the boom is approaching the centerline. When the boom has reached the centerline it is totally out of control. Remembering that the high unwanted boom velocities initiated around the centerline position, the system is of limited use.

OBJECT

To put forward a simple and reliable system for controlling the jibe movement of a boom.

THE NOVELTY OF THE INVENTION

The novel system is characterized in that a hydraulic actuator is connected with the inner boom end at the pivot joint, which hydraulic actuator is transferring a passive momentum to the inner boom end acting against boom movements.

Advantages.

Hereby is obtained an unforeseen simple system, which controls the jibe movements of a sailboat boom in a reliable manner, without any risk of damaging the rigging or enduring any persons. The system gives the total control of the angular motion of the boom within every angular section of the 180 degrees travel of the boom from the one side perpendicular position, passing the centerline position and to the other side perpendicular position.

Mode of Operation.

The hydraulic actuator transfers a pivoting momentum to the boom directly in the pivot joint at every angular motion of the boom. When the boom is swung from a perpendicular position at the one side of the boat and to a perpendicular position at the other side passing the centerline position, the boom movement will have to act against the passive momentum whereby the angular velocity of the boom will be reduced to a safe limit under all wind conditions. Should the boom start up an unintentional jibing manoeuvre by swinging of its own motion, the actuator will still act with a momentum against the pivoting of the boom slowing down the violent swinging in a controlled manner as well.

Advantageous Embodiments.

Expedient embodiments according to the invention is put forward in the subclaims.

It should further be mentioned that when the system comprises a hydraulic valve function limiting the flow of the pressure media in the actuator, the angular velocity of the boom is reduced to predetermined safe level.

When the system comprises a safety valve limiting the available hydraulic pressure in the actuator, an upper limit is set for the active momentum, which can be trans-ferred to the pivot joint end of the boom, whereby damage of the boom and the system is avoided should the boom be obstructed in its angular movement.

When the system comprises a control valve shutting off the flow of the pressure media except to the safety valve, the angular boom movement can be stopped and subsequently up-started at any desirable angular position in an expedient manner, which for example is convenient when trimming the backstays of the boats rigging during the gibe.

When the actuator comprises a working machine for trans-ferring an active momentum to the pivot joint end of the boom, an actively controlled boom movement is possible.

The working machine can in a very expedient embodiment be carried out as a cylinder.

DESCRIPTION OF THE DRAWING

The invention will be explained more fully below with reference to the drawing, in which.

DETAILED DESCRIPTION OF ADVANTAGEOUS EMBODIMENTS

Figure 1:
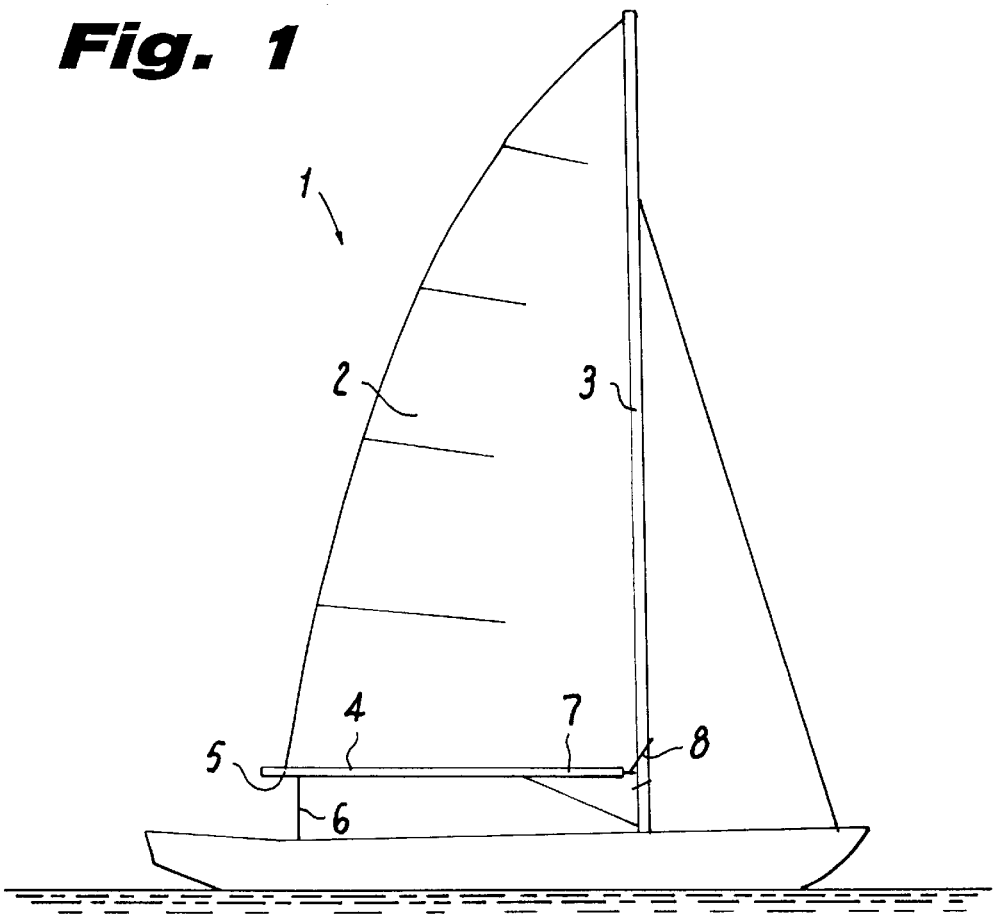
FIG. 1 is a schematic side view of a sailboat equipped with the device according to the invention.
Figure 2:
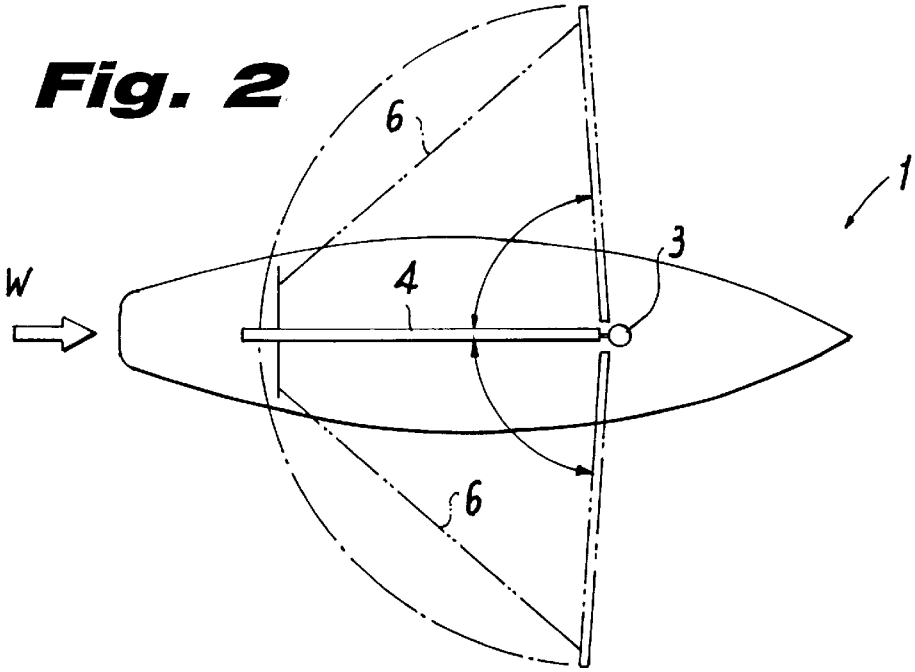
FIG. 2 shows the same, seen from above during an articulated jibemanoeuvre.
Figure 3:
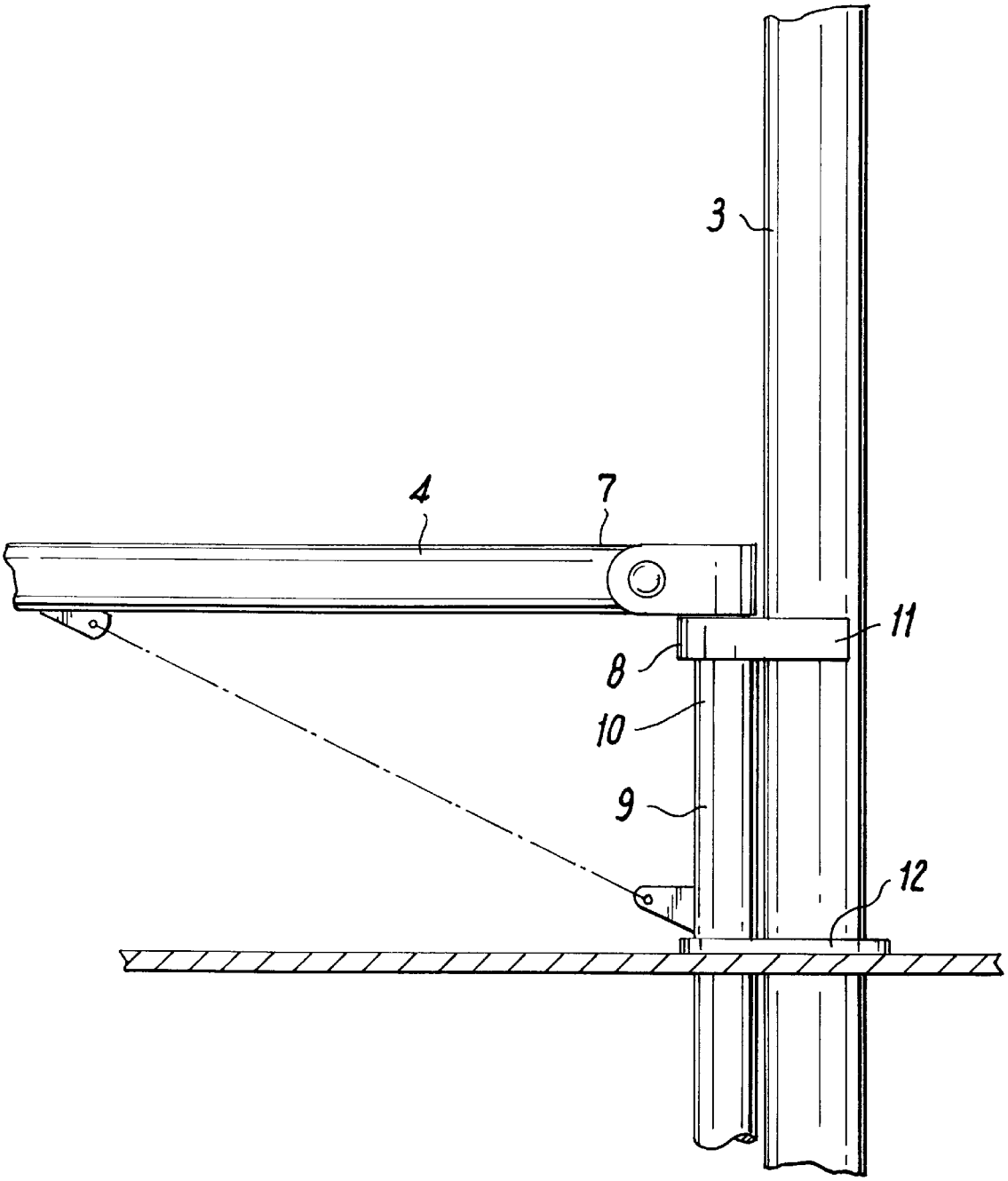
FIG. 3 is a schematic side view of part of the device, comprising a vertically extending axle connected to the boom at the pivot joint on the mast.

The sailboat 1 shown in FIG. 1 comprises a mainsail 2, which is hoisted on a mast 3 and is fixed to a boom 4. The boom 4 has an outer free end 5 connected to the boat 1 via a sheeting arrangement 6, and an inner end 7 fixed to the mast 3 via a pivot joint 8. By this traditional arrangement the boom is allowed to approach an angle of up until approximately 90 degrees to the centerline of the boat, when the boat is running before the wind W, as shown in FIG. 2. The approach angle of the boom 4 is adjusted by hauling or releasing the sheeting arrangement 6. During jibing manoeuvres the boom must be swung from its essentially perpendicular position at the one side of the boat, and over the centerline to a perpendicular position at the other side of the boat.

The crossover of the boom is traditionally initiated by a rudder controlled change in the sailing direction of the boat, and by hauling and subsequent releasing of the sheeting arrangement to force the boom over the centerline of the boat. When the jibing manoeuvre is carried out with a larger sailboat, the cross over of the boom is normally very sudden and violent. When the manoeuvre is carried out in strong winds and rough sea conditions, it may be intentional or unintentional, the result can be disastrous, both for the rigmaterial as well as for a person, who is hit by the boom, sheet or another moving part.

Preferred embodiments of the system according to the invention shall be further explained, and comprises an actuator which is connected to the inner boom end at the pivot joint 8. The connection comprises a vertically extending axle 9, the upper end 10 of which is rigidly connected to the inner boom end 7 at the pivot joint 8. The angular motion of the boom 4 will hereby follow the same angular motion as the axle 9 does. The axle 9 is fixed to the mast 3 by way of fittings 11, 12 comprising bushings for support of the axle. The lower end 11 of the axle 9 is connected to the actuator, as shown in FIGS. 4 and 5.

Figure 4:
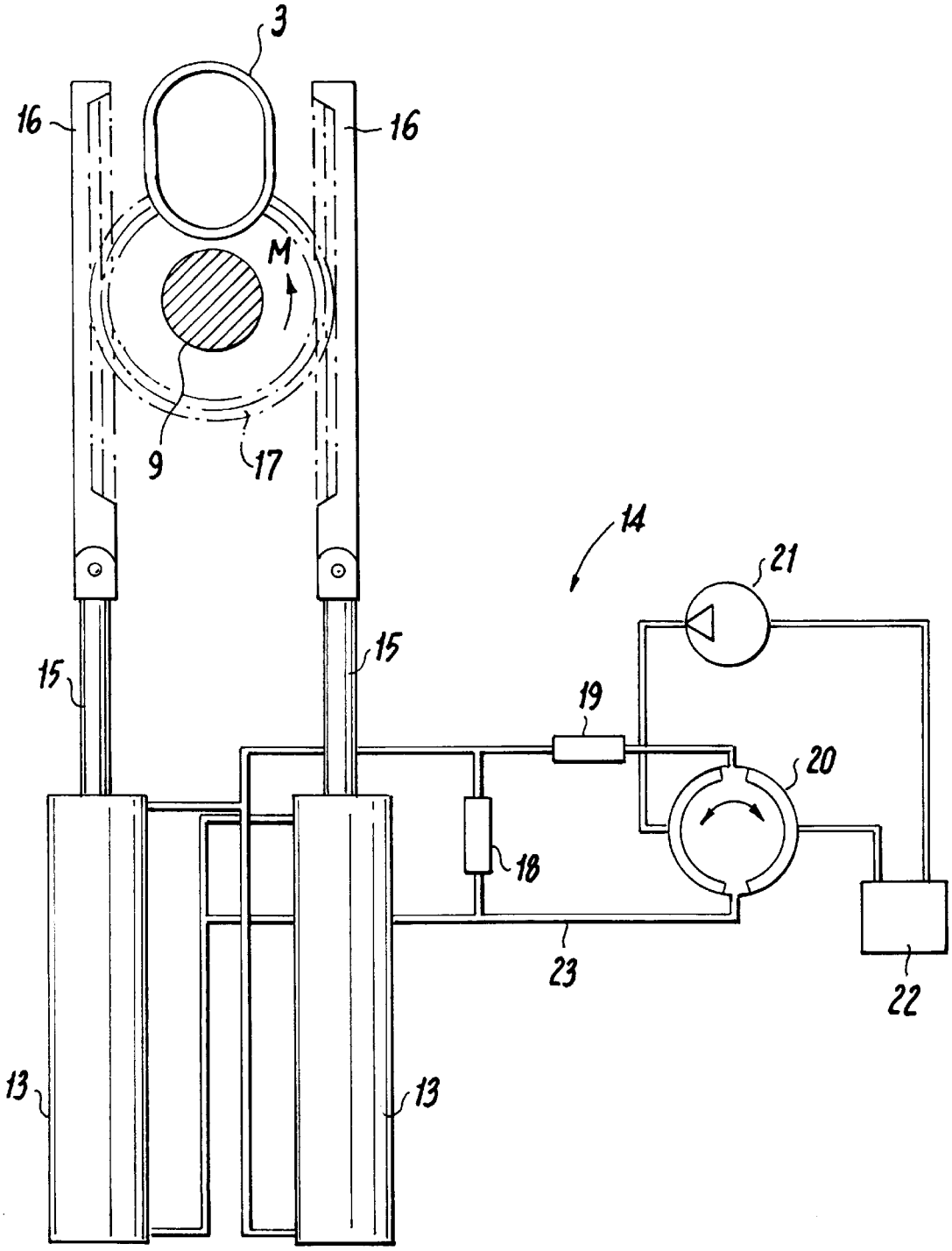
FIG. 4 shows another part of the device comprising an actuator, seen from above.
Figure 5:
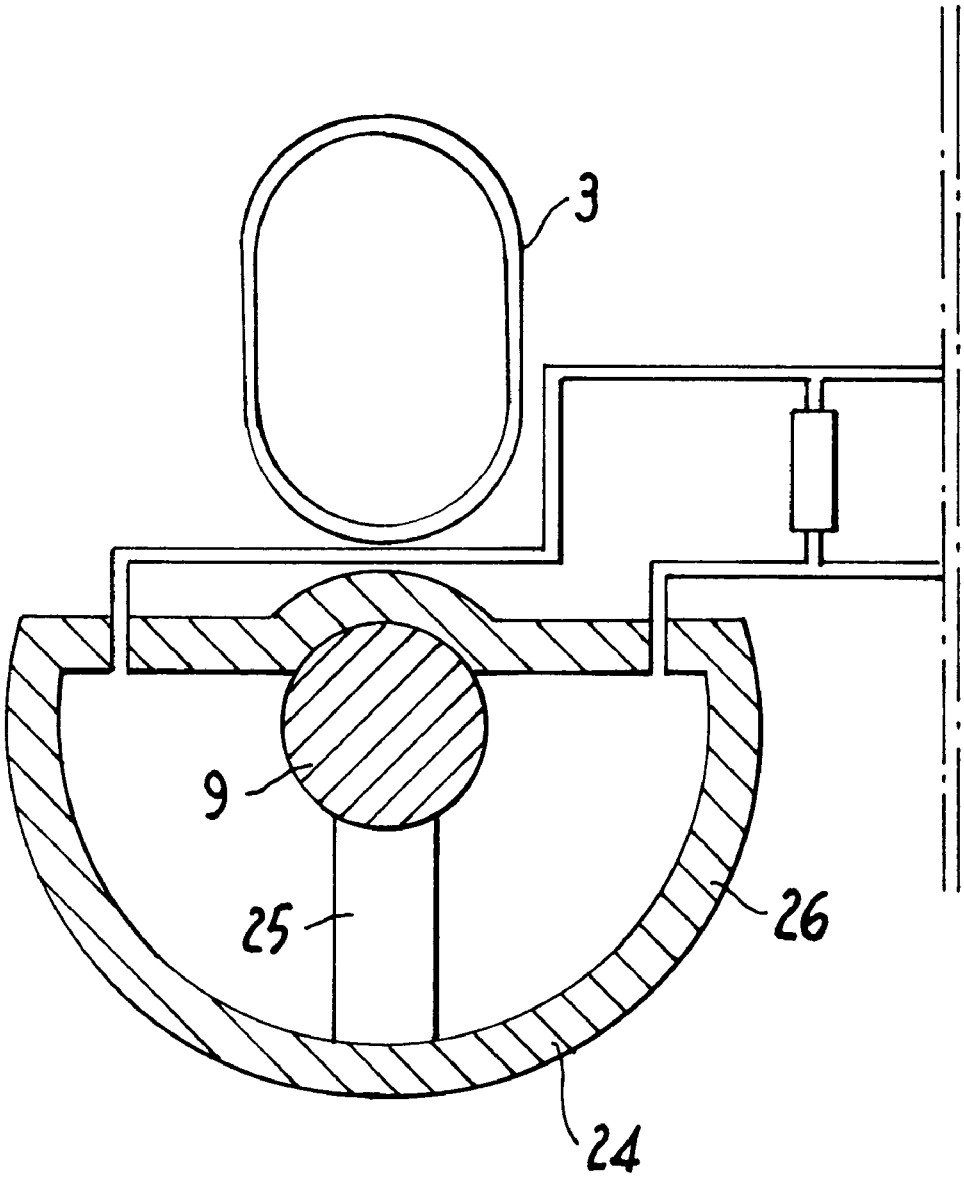
FIG. 5 shows another embodiment of the actuator.

According to the one preferred embodiment shown in FIG. 4, the actuator can be in the form of hydraulic cylinders 13 incorporated in a hydraulic system 14, which is installed under the deck of the boat. The piston rods 15 of the hydraulic cylinders 13 are extended by toothed racks 16, which is in engagement with a common gearwheel 17 fixedly mounted to the lower end 11 of the axle 9.

The hydraulic system comprises conventional control means in the form of a safety/overload valve 18, an adjustable throttle valve 19, a control valve 20, as well as a pump 21 and a tank 22 for the hydraulic pressure media all connected together via conduits 23.

The control valve 20 is advantageously installed so that it can be activated directly from the cockpit of the sail-boat 1.

In the most simple form of the system, it advantageously comprises a throttle valve 19, whereby the oil will be throttled when a maximum oil flow is reached in the cylinders 13. The hydraulic cylinders can hereby act as passive resistance means for transferring a passive momentum against the boom movement, so that the angular velocity of the boom always is slowed down to a predetermined safe level under all gibing manoeuvres. This is especially expedient in the case of an uncontrolled jibe, as the boom movement is slowed down to a safe level.

By guiding oil pressure to the appropriate sides of the pistons of the hydraulic cylinders 13, an active control of the boom movement can also be performed. Thereby the toothed racks 16 can be brought to travel forth and back so that the gearwheel 17 is rotated and active momentum is brought to the axle 9. The active control of the boom is limited in speed and momentum by the valves 18 and 19.

A jibing manoeuvre can hereby be carried out in an actively controlled manner by one person who activates the control valve 20, advantageously by turning a knob to the right when the boom should be turned over from a position at the left side of the boat to the right side or visa versa. Hereby is obtained a system for carrying out fully controllable jibing manoeuvres without the risk of damaging any material or persons. If turning of the control valve 20 is halted during any jibe the boom will simply stop in that corresponding angular position so that backstays of the rig can be trimmed before the boom is allowed to fulfil the angular motion.

Another advantageously embodiment is shown in FIG. 5, where the axle 9 is guided directly into the housing 26 of a hydraulic working machine 24. The axle is equipped with a flap 25, which is under influence of oil pressure. The remaining parts of the hydraulic control system can be laid out as it is shown in FIG. 4. In the passive control mode, the flap acts against the oil pressure as in the case of the cylinders. In the active control mode the flap is driven by active oil pressure to the one or the other side in the housing with a rotation of the axle 9 as a result, whereby the boom is forced to conduct an angular motion.

It should be mentioned that a great bending momentum is transferred in the fixed connection between the upper end 10 of the boom 4 and the inner end 7 of the boom 4, so that a very strong connection is necessary. Such a connection could comprise the traditional vang or kickingstrap means as well as other stiffening means.

Careful testing have been carried out with a system for a slooprigged sailboat with an overall length of 75 feet. The length of the boom is 8 m and the sailarea of the mainsail is 100 m2. At a windstrength of Beaufort 6 the windspeed is approximately 11 m/s, which gives a calculated sailpressure of 100 N/m2. The calculated momentum of the axle 9 is at this pressure approximately 27000 N/m. The momentum to be transferred to and from the hydraulic actuator can hereby be calculated as a simple matter of routine, as well as the necessary strength of the axle 9 can be calculated within safe margins.

It should be mentioned that other expedient embodiments can be carried out within the scope of the invention comprising other actuator means such as a conventional motor connected to the pivot joint via a gearbox.

I claim:

1. A system for controlling the jibe movements of a sailboat boom, which boom has an outer free end connected to the boat via a sheeting arrangement, and an inner end fixed to the mast via a pivot joint, comprising a hydraulic actuator connected with the inner boom end at the pivot joint, said hydraulic actuator transferring a passive momentum (M) to the inner boom end acting against boom movements.

2. A system according to claim 1, further comprising an axle connecting the inner boom end and the actuator which is substantially parallel with the mast.

3. A system according to claim 2 wherein the axle has an upper end which is fixed to the inner boom end at the pivot joint so that the axle follows the same angular motion as the boom, and the lower end of the axle is connected to the actuator.

4. A system according to claim 1, wherein the axle has an upper end which is fixed to the inner boom end at the pivot joint so that the axle follows the same angular motion as the boom, and the lower end of the axle is connected to the actuator.

5. A system according to claim 1, wherein the connection between the inner boom end and the actuator comprises engaging, toothed segments.

6. A system according to claim 5, wherein the toothed segments comprise at least one pair of an engaging gearwheel and rack wherein the gearwheel is in connected with one of the inner end of the boom and the actuator, and the rack is connected to other of the boom and the actuator.

7. A system according to claim 1 further comprising a hydraulic valve limiting the flow of the pressure media in the actuator, to control the angular velocity of the boom.

8. A system according to claim 1 further comprising a safety valve for limiting the available hydraulic pressure in the actuator to set an upper limit for the active momentum, which can be transferred to the pivot joint end of the boom.

9. A system according to claim 1 further comprising a control valve for shutting off the flow of the pressure media except to the safety valve to stop and start the angular boom movement at any desirable angular position.

10. A system according to claim 1 wherein the actuator comprises a working machine for transferring an active momentum (M) to the pivot joint end of the boom to produce an actively controlled boom movement.

11. A system according to claim 10 wherein the working machine comprises a hydraulic cylinder.

* * * * *

UNITED STATES PATENT AND TRADEMARK OFFICE

CERTIFICATE OF CORRECTION

PATENT NO. : 5,967,073

DATED : October 19, 1999

INVENTOR(S) : Ole Simon PETERSEN

It is certified that errors appear in the above-identified patent and that said Letters Patent is hereby corrected as shown below:

On the title page: Item

[73] Assignee place of residence, change "FrolundA" to --Frolunda--.

Signed and Sealed this

Twenty-fifth Day of April, 2000

*Attest:*

*Attesting Officer*

Q. TODD DICKINSON

*Director of Patents and Trademarks*